US005246205A

United States Patent [19]

Gillingham et al.

[11] Patent Number: 5,246,205

[45] Date of Patent: Sep. 21, 1993

[54] VALVE ASSEMBLY AND USE

[75] Inventors: Gary R. Gillingham, Prior Lake; James C. Rothman, Burnsville; Peter A. Betts, Prior Lake; Wayne M. Wagner, Apple Valley, all of Minn.

[73] Assignee: Donaldson Company, Inc., Minneapolis, Minn.

[21] Appl. No.: 864,402

[22] Filed: Apr. 6, 1992

[51] Int. Cl.[5] ..... F16K 1/34; F16K 1/48; F01N 3/02

[52] U.S. Cl. ..... 251/334; 251/61.4; 251/61.5; 251/86; 55/282; 60/286

[58] Field of Search ..... 251/334, 61.4, 902, 251/86, 61.5; 55/282; 60/286

[56] References Cited

U.S. PATENT DOCUMENTS

| | | | |
|---|---|---|---|
| 24,416 | 6/1859 | Tate | 251/334 |
| 1,585,732 | 5/1926 | Otto et al. | 251/61.4 |
| 2,927,571 | 3/1960 | Kamlukin . | |
| 3,318,116 | 5/1967 | Houser et al. . | |
| 3,322,142 | 5/1967 | Baumann | 251/61.4 |
| 3,462,666 | 8/1969 | Martinek . | |
| 3,499,269 | 3/1970 | Bois . | |
| 3,772,751 | 11/1973 | Lovett . | |
| 4,024,054 | 6/1991 | Barris et al. . | |
| 4,167,852 | 9/1979 | Ludecke . | |
| 4,264,344 | 4/1981 | Ludecke et al. . | |
| 4,281,512 | 8/1981 | Mills . | |
| 4,373,330 | 2/1983 | Stark . | |
| 4,386,497 | 6/1983 | Takagi et al. . | |
| 4,404,796 | 9/1983 | Wade . | |
| 4,428,758 | 1/1984 | Montierth . | |
| 4,436,535 | 3/1984 | Erdmannsdorfer et al. . | |
| 4,485,622 | 12/1984 | Takagi et al. . | |
| 4,505,106 | 3/1985 | Frankenberg et al. . | |
| 4,512,147 | 4/1985 | Wong . | |
| 4,535,588 | 8/1985 | Sato et al. . | |
| 4,538,411 | 9/1985 | Wade et al. . | |
| 4,538,412 | 9/1985 | Oishi et al. . | |
| 4,544,388 | 10/1985 | Rao et al. . | |
| 4,558,565 | 12/1985 | Kojima et al. . | |

(List continued on next page.)

FOREIGN PATENT DOCUMENTS

| | | | |
|---|---|---|---|
| 732966 | 4/1966 | Canada | 251/334 |
| 4004424A1 | 8/1990 | Fed. Rep. of Germany . | |
| 2538449 | 6/1984 | France . | |
| 22466 | 2/1982 | Japan | 251/334 |
| WO85/02785 | 7/1985 | PCT Int'l Appl. . | |
| 9020 | of 1899 | United Kingdom | 251/334 |

OTHER PUBLICATIONS

Article 860290, Study on Catalytic Regeneration of Ceramic Diesel Particulate Filter, Yoshinori Niura, Kenji Ohkubo, and Kunihiro Yagi, Technical Research Center Mazda Motor Corp., pp. 163–172.

Article 870012, Development and Selection of Diesel Particulate Trap Regeneration System, Minoru Arai, Shoichiro Miyashita, and Kaoru Sato, First Light Duty Engine Engineering Department Isuzu Motors Ltd., Japan, pp. 27–36.

*Primary Examiner*—Arnold Rosenthal

*Attorney, Agent, or Firm*—Merchant, Gould, Smith, Edell, Welter & Schmidt

[57] ABSTRACT

A poppet valve assembly is provided. The preferred poppet valve assembly comprises a valve seat, valve head member and actuation arrangement. In the preferred embodiment, the valve head member comprises a flexible seal member and backing member, oriented such that the flexible seal member is positioned between the valve seat and the backing member. In use, the backing member is driven toward the valve seat, trapping the flexible seal member therebetween. The seal member engages the valve seat and is simultaneously deflected backward toward the backing member, which limits deformation of the seal member.

22 Claims, 8 Drawing Sheets

U.S. PATENT DOCUMENTS 4,562,695 1/1986 Rao et al. .
4,573,317 3/1986 Ludecke .
4,604,868 8/1986 Nomoto et al. .
4,634,459 1/1987 Pischinger et al. .
4,651,524 3/1987 Brighton .
4,744,217 5/1988 Goerlich et al. .
4,752,516 6/1988 Montierth .
4,832,661 5/1989 Wagner et al. .
4,851,015 7/1989 Wagner et al. .
4,867,768 9/1989 Wagner et al. .
4,878,928 11/1989 Wagner et al. .
4,899,540 2/1990 Wagner et al. .
4,916,897 4/1990 Hayashi et al. .
4,961,314 10/1990 Howe et al. .
4,974,414 12/1990 Kono et al. .
4,986,069 1/1991 Barris et al. .
5,009,065 4/1991 Howe et al. .
5,014,511 5/1991 Wade et al. .
5,053,062 10/1991 Barris et al. .
5,053,603 10/1991 Wagner et al. .

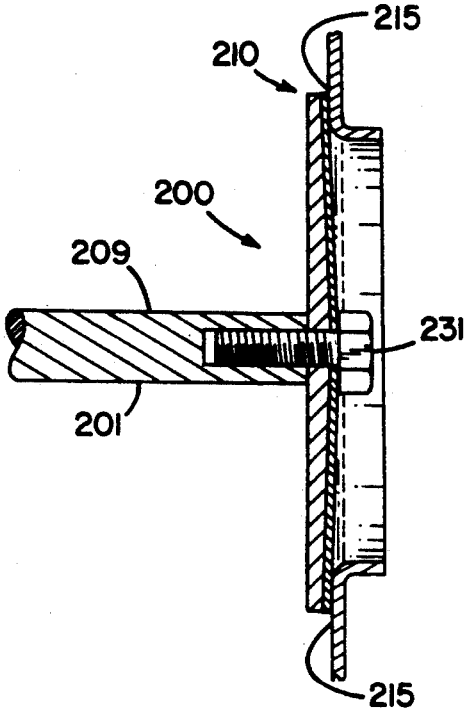
FIG. 6
FIG. 7
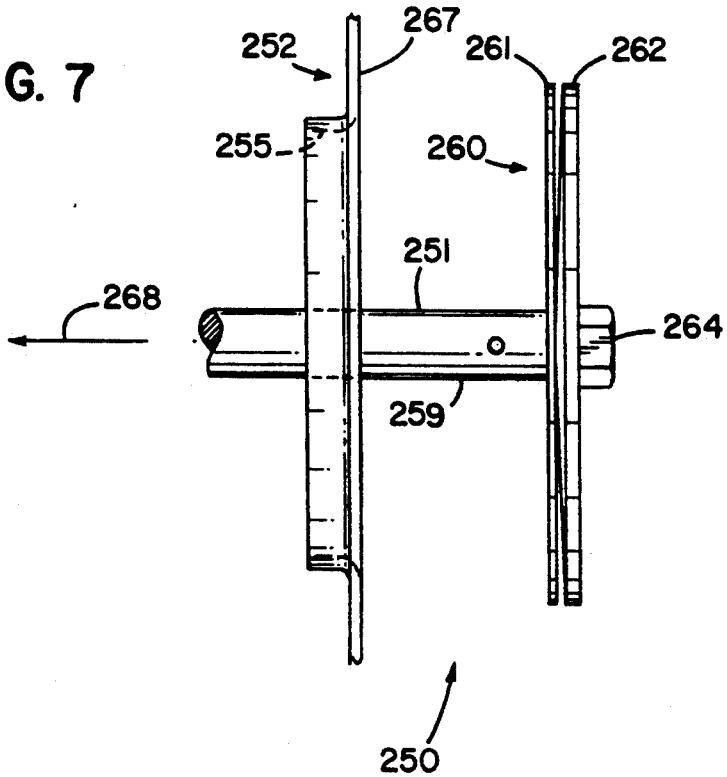

VALVE ASSEMBLY AND USE

FIELD OF THE INVENTION

The present invention is directed to valve assemblies. More specifically, it is directed to a poppet valve assembly particularly well adapted for use under relatively high temperature applications, for example to control gas flow in an engine exhaust stream. The invention also concerns use of the valve assembly, especially in a particular application.

BACKGROUND OF THE INVENTION

In general, the structure of any given valve assembly is greatly dictated by the conditions of intended use. In particular, the amount of back pressure likely to be encountered, the nature of the flowable medium to be controlled, the temperature of the system, the temperature fluctuations likely to be encountered by this system, the presence or absence of particulate material in the flow to be controlled, the power source available for control of the valve, size and space limitations, whether or not the conditions of use will likely subject the components of the assembly to substantial shock or vibration, and similar variables on conditions of use will dictate advantage and disadvantage to various valve assembly designs, for use in any given system. In addition, economic factors, such as cost and availability of components, will also dictate valve construction in certain uses. Further, the amount of leakage which can be tolerated and the likelihood and effect of pressure surges, with respect to the process being controlled by the valve assembly, will in part dictate limitations on the type or construction of valve. The amount of "valve stick" that can be safely tolerated; whether the valve is normally maintained "open" or "closed" in use; and, the geometric tolerances of the system, are also factors which effect valve design.

In certain applications, poppet valve assemblies are used. A schematic generally indicating a conventional poppet valve assembly is shown in FIG. 1. Referring to FIG. 1, poppet valve assembly 5 comprises poppet valve member 6 and valve seat 7. In use, the poppet valve member 6 is biased against the valve seat 7, in sealing relation, when it is desired to close fluid flow through aperture 9, defined by the valve seat 7. Such a system might be used, for example, for controlling air or exhaust gas flow.

More specifically, poppet valve 6 comprises a shaft or stem 12 and valve head 13. Valve head 13 is sized and configured for mating with aperture 9 in a sealing fashion, during use. The stem 12 is used to direct the valve head 13, selectively, into and out of sealing relationship with aperture 9. The stem 12 is movably mounted, for example by being slidably received within bushing 15, to operationally direct the valve head 13. A variety of means may be utilized to direct or control movement of the stem 12 and valve head 13, the embodiment shown in FIG. 1 utilizing actuator 19.

In conventional poppet valve arrangements such as that shown in FIG. 1, a variety of means have been utilized to accomplish the sealing relationship between the valve head 13 and the aperture 9. In some instances either the valve head 13, the aperture 9 of the valve seat 7, or both, are provided (lined) with a soft compressible material such as a polymeric material, for formation of a seal under pressure with the other component. In other instances, relatively hard, non-compressible materials such as metal, machined for precise sealing engagement have been used for the valve head 13 and valve seat 7. The assembly shown in FIG. 1 involves utilization of a steel head 25 precisely machined along frustoconical surface 26 for snug, sealing, relationship with recessed surface 28 of valve seat 7.

The conventional poppet valve assembly 5 of FIG. 1 is shown constructed such that stem 12 is selectively biased toward valve seat 7, when it is desired that aperture 9 be closed to fluid flow therethrough. Alternate systems, for example in which the stem is biased away from the aperture during use, are known. One such conventional system is illustrated in FIG. 2.

Referring to FIG. 2, valve assembly 30 comprises poppet valve member 31 and valve seat 32. Valve seat 32 is defined by aperture 35, which allows flow of fluid therethrough when the valve is open. Poppet valve member 31 comprises stem 37 with head 38 mounted thereon. For the arrangement shown in FIG. 2, the stem 37 is shown slidably mounted in bushing 40 for selective positioning relative to seat 32. Movement of stem 37, selectively, for opening and closing of aperture 35 is generated by a biasing arrangement 42. For the illustration in FIG. 2 the biasing arrangement 42 comprises actuator 43.

The valve assembly 30 operates for closure upon movement of the stem 37 in a direction opposite to that of the arrangement 5 shown in FIG. 1. In particular, aperture 35 is closed when stem 37 is manipulated to pull head 38 into seat 32. Similar means, for providing the sealing relationship between the head 38 and the valve seat 32, may be used for assembly 30 of FIG. 2 as were described above with respect to assembly 5 of FIG. 1.

It is noted that conventional poppet valve assemblies such as those shown in FIGS. 1 and 2 are known for use in systems wherein fluid flow is in either direction with respect to the aperture. That is, for example referring to FIG. 1 showing poppet valve assembly 5, such systems have been utilized to close aperture 9 to passage of fluid flow therethrough, when the pressure of the fluid flow is from either direction; i.e., both when the sealing pressure on the valve head 13 applied by the stem 12 is against the direction of the fluid flow and also when the sealing pressure is in the same direction as fluid flow.

The present invention concerns a particular poppet valve assembly, described hereinbelow, which addresses certain types of problems that can arise if a conventional poppet valve assembly such as that generally described with respect to FIGS. 1 and 2 were utilized in certain circumstances. A particular application of use, i.e., in association with a particulate trap for diesel exhaust, is described in detail hereinbelow.

SUMMARY OF THE INVENTION

According to the present invention there is provided a poppet valve assembly including a valve seat, a valve head member and actuation means for biasing the valve head member against the valve seat, to close same. More specifically, operation of the value concerns biasing a flexible seal member (preferably a metallic flexible seal member) against a more rigid member, to form a seal. This may be accomplished by motion of the flexible member, the rigid member or both. In certain preferred applications, the flexible member is oriented between two relatively rigid members, and is deformed therebetween when the seal is formed. The preferred seal member is deflected back toward a first rigid member, when a second rigid member is encountered. In a preferred embodiment, the first rigid member and the seal member are biased toward the second rigid member during sealing. The seal member is preferably constructed of a material such as stainless steel or Inconel which can be deflected under sealing pressures, to form a good seal, when the sealing pressure is substantially less (preferably less than 50%) than the yield stress (or point of fatigue) of the seal member. That is, the seal member provides a spring tension to maintain the seal, under closure pressure.

In one preferred embodiment, the valve head member comprises a flexible seal member and a backing member, the seal member and backing member being oriented in juxtaposed, and preferably adjacent relation to one another. The backing member in this preferred embodiment has a convex surface oriented in direction toward the flexible seal member. In the valve assembly, the flexible seal member is oriented between the backing member and the valve seat. In use, the valve assembly is used to close a valve aperture by biasing the flexible seal member against a flat non-recessed surface of the valve seat and simultaneously biasing the flexible seal member toward the convex surface of the backing member. In some applications, the flexible seal member may be biased completely against the backing member. In others, the spring strength of the flexible member will be sufficiently great to provide a good seal even when biased partly toward the backing member. The term "convex" as used herein in this context is meant to refer to a surface which has a generally centrally located apex. The curvature from that apex (for example spherical, conical or parabolic) is not intended to be defined by the term "convex" in this context.

Preferred poppet valve assemblies according to the present invention have flat, circular, flexible seal members and circular backing members. Preferably, the circular backing member has a spherical curvature, to provide for the convex side.

In most preferred applications, the spherical curvature of the flexible backing member is sufficient so that at their outer peripheries the flexible seal member and backing member are spaced at least about 0.020 inches (0.05 cm) apart, more preferably at least about 0.030–0.050 inches (0.08–0.13 cm) and up to about 0.080–0.100 inches or (0.2–0.25 cm) apart. Also, preferably the seal member comprises a flexible metal sheet, such as a stainless steel sheet, sufficiently flexible to be deflected toward the backing member convex side under an applied force within the range of about 12–18 pounds. Alternately, and more generally stated, preferably the flexible seal member has the following characteristics: sufficient memory to return to its unbiased shape when the valve is open; and, of material which will bias under sealing pressures sufficiently to form a good seal, when the stress applied is substantially below (preferably less than 50% of) the yield stress of the member. In this context "sealing pressure" and variants thereof refer to the pressure of closure for the valve. The term "yield stress" means the stress under which the material is permanently deformed.

Poppet valve assemblies according to the present invention may be utilized in a variety of applications, but they are particularly well adapted for use in hot gas exhaust systems, i.e. exhaust systems for outward flow of gas at temperatures of about 600° F. (315° C.) or greater. They are readily usable in systems involving relatively large flow passageways, i.e. passageways on the order of at least about 4 cm to 8 cm in diameter. Preferably for such systems the size of the seal member is at least about 0.8 cm greater than the diameter of the flow aperture, to allow a border of overlap of at least about 0.4 cm completely around the flow aperture.

Preferably poppet valve assemblies according to the present invention include actuation means involving a valve stem on which the valve head is mounted in use. The valve stem may be provided as a flexible member, to advantage. In one preferred application, a swivel fastener is used for mounting, to allow some wobble between the head and the stem. In certain preferred applications, the stem may be provided with a flexible coupling therein, to allow flexibility of movement. Alternatively, the stem may be constructed and arranged of flexible material.

The actuation means may comprise a variety of systems, including solenoid, vacuum and/or pressure actuators. Certain preferred constructions are described in detail.

Preferred assemblies according to the present invention utilize a plate and flexible metal bellows arrangement, as part of the actuation means for movement of the stem. The plate and flexible metal bellows allow for seal between two regions of controlled pressure. Variation in relative pressure between the two regions can be utilized to cause movement of the plate and valve stem. In some applications, it will be desirable to provide a biasing member such as a safety spring oriented to preserve the valve in either an opened or closed orientation, under failure conditions.

According to the present invention an assembly is provided for control of hot gas flow, involving application of a poppet valve assembly according to the present invention in a system of gas flow of relatively high temperatures, i.e. at least about 300° F. (149° C.), and generally at 600° F. (315° C.) or greater. Preferred applications involve such assemblies which include diesel exhaust particulate traps therein, and means for regenerating the particulate trap. The valve assembly may be positioned either upstream from the particulate trap or downstream therefrom. The valve assemblies may be utilized in systems involving a plurality of traps, with a plurality of apertures to be controlled by a plurality of valve assemblies.

BRIEF DESCRIPTION OF THE DRAWINGS

FIG. 6 is an enlarged fragmentary view analogous to FIG. 5, but showing the valve assembly in a closed orientation.

FIG. 7 is an enlarged fragmentary side elevational view of a first alternative embodiment of a poppet valve assembly according to the present invention, shown open.

DETAILED DESCRIPTION OF THE INVENTION

Figure 1:
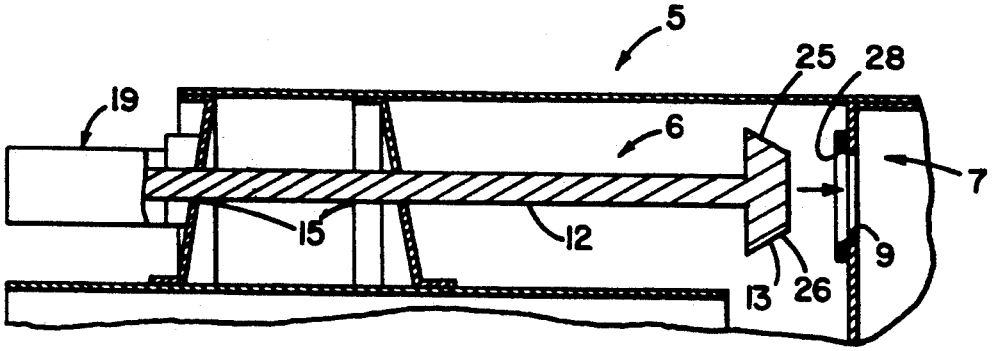
FIG. 1 PRIOR ART
FIG. 1 is a fragmentary schematic view of a prior art poppet valve assembly.

Some Problems Observed With Conventional Poppet Valve Assemblies

Hereinabove in the section entitled Background of the Invention a brief description of conventional poppet valve assemblies was provided, with reference to FIGS. 1 and 2. In certain applications to control fluid flow, such conventional assemblies are not completely satisfactory. Some of the problems associated with such an assembly will be better understood, by reference to a particular application.

Consider the utilization of a poppet valve assembly to control exhaust gas flow through a valve seat, in a diesel exhaust system on a truck or bus. Utilization of soft polymeric sealing material on either or both of the valve seat or valve head, to assure good seal, is generally obviated by the relatively high temperature (300° F. up to 1000° F. or more, i.e., 149° C.–536° C.) of the exhaust gases. Such temperatures will facilitate degeneration of the polymeric material, and loss of seal. Also, valve sticking may become a problem, as the polymeric material loses its integrity.

The utilization of a hard metal head machined for mating with a hard, recessed, metal seat (not subject to degeneration upon exposure to temperatures of use) is feasible for such applications, but not completely desirable. For example, such a use would involve the need for precision machining of components, and tight tolerances during manufacture and assembly, and thus results in relatively high expense. In addition, finely machined components for such portions of an assembly are not desirable in vehicle use for a variety of reasons. For example, trucks and buses are subject to substantial vibration in use, and the components may not retain their precise alignment under such conditions of use. Should the components become misaligned even slightly, a good seal may no longer result since the seal is dependent upon finely machined, engaging components. Further, diesel exhaust systems are subject to wide temperature fluctuations between, for example, very cold environmental temperatures when the engine is shut off in the winter and very high temperatures when large amounts of hot exhaust are passing therethrough, under heavy engine use. Such wide fluctuation in temperatures will lead to substantial stress on points of connection and alignment, tending to misalign components and to lead to a "loosening" of the valve, i.e., valve leakage.

In spite of the above problems, it is desirable to utilize a poppet valve construction (with metal components) in systems such as diesel exhaust systems, for gas flow control, for a variety of reasons. First, actuation mechanisms for them are relatively simple, efficient and cost effective. Also, they can be maintained rather easily. Very significantly, they do not readily stick even under relatively adverse conditions and when used for extended periods of time.

A Particular Application for Use of a Poppet Valve Assembly According to the Present Invention The poppet valve assembly of the present invention was developed in part from the needs presented by a particular application of use. More specifically, the need had arisen for an alternate poppet valve assembly to conventional ones, for use in controlling exhaust gas flow in a diesel engine particulate trap. It is not meant by this that valve assemblies according to the present invention are limited to such systems for use, but rather that the advantages they provide are well suited for such applications.

Figure 3:
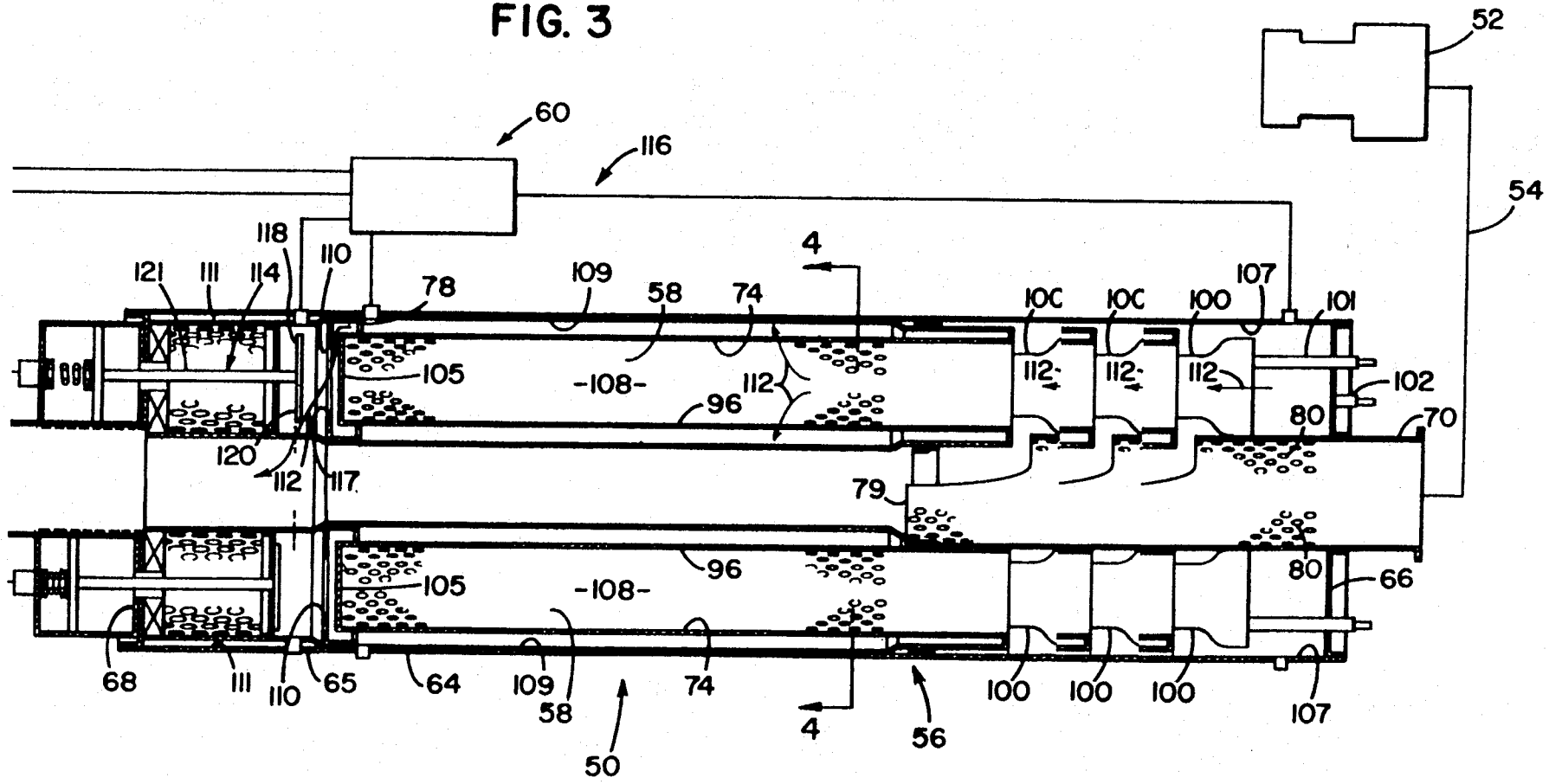
FIG. 3 is a schematic view of a muffler-particulate trap incorporating a poppet valve assembly according to the present invention.

With respect to disclosures concerning diesel particulate traps, a general understanding of such systems is provided by the following description, relating to FIG. 3.

In general, the arrangement illustrated in FIG. 3, is for control of particulate emissions (black smoke) from diesel engines. In response to a need to reduce engine particulate emissions, vehicle and engine manufacturers have been developing particulate trap systems which operate to cleanse the exhaust of particulate material before the gases are discharged to the atmosphere. The arrangement of FIG. 3 is a particular such system, which may generally be referred to as a trap-oxidizer. A trap-oxidizer system generally includes a temperature resistant filter (the trap) which collects the particulates and from which the particulates are periodically burned off (oxidized), a process generally referred to as regeneration. The traps are regularly regenerated so as not to become excessively loaded with particulate material, and thereby create an undesirable back pressure and reduction in engine efficiency and performance.

Figure 4:
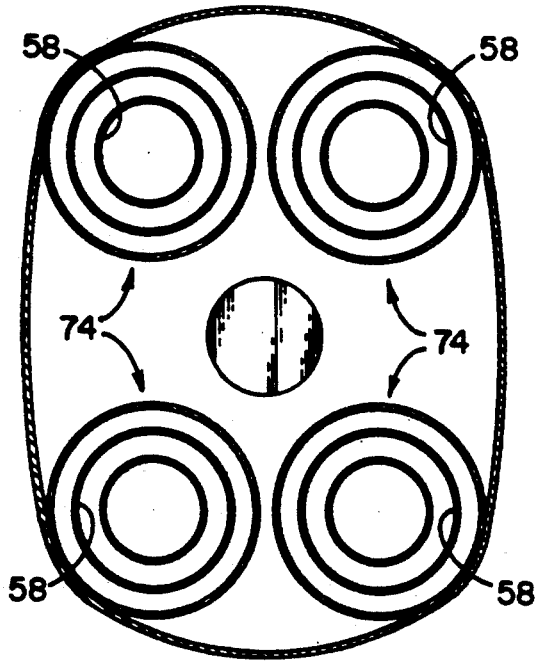
FIG. 4 is a cross-sectional view taken along line 4—4, FIG. 3.

Trap-oxidizer regeneration systems can be divided into two major groups, primarily on the basis of control philosophy. One group is positive regeneration systems; the other group is self-regeneration systems. Positive regeneration systems include the application or use of a fuel fed burner, electric heater or other technique, to raise the temperature of the exhaust gases at selected times, and initiate and control oxidation of particulates in the trap, for regeneration. Self-regeneration systems are directed, for example, to the use of catalysts to lower the ignition temperature in the captured particulates. Thus, added energy through a burner or the like need not be added to the system, to cause ignition and oxidation of the particulates. The system illustrated in FIGS. 3 and 4 is a positive regeneration system.

A variety of types of traps may be utilized in association with a system such as that shown in FIG. 3. Particularly well-adapted trap systems are those utilizing ceramic filter elements through which the exhaust gases are directed. Particulate material in the exhaust gases becomes lodged in the ceramic element, as the exhaust gases are passed therethrough. The ceramic element is later regenerated, upon application of ignition heat by an electric heater or the like.

Referring to FIG. 3, a system for processing exhaust gases from an engine is designated generally by the numeral 50. The system 50 is in fluid flow (gas flow) communication with engine 52, to receive exhaust gases therefrom via line 54. System 50 includes a muffler-filter apparatus 56 which includes a plurality of ceramic fiber filter tubes 58. The regeneration of filter tubes 58 is accomplished via control mechanism 60.

Apparatus 50 includes a housing 64 comprising an elongated curved wall 65 with opposite end walls 66 and 68. An inlet tube 70 extends at a central location through wall 66. An outlet tube 72 extends at a central location through wall 68. Four filter tube modules 74 (FIG. 4) are installed within housing wall 64 in a symmetrical arrangement. Modules 74 are supported inter alia by support plate 78. There is also support means, not detailed, for a downstream end 79 of inlet pipe 70.

Inlet pipe 70 is closed at the downstream end 79 and has perforations 80 between the downstream end 79 and wall 66. As a result, exhaust gases are directed through the perforations 80 and through the filter modules 74.

A variety of constructions of filter modules may be utilized in the system of FIG. 3. For example, filter modules 74 may comprise low mass, perforated filter tubes with ceramic fiber yarn wrapped thereabout. Structural support for each of the filter tube modules 74 is provided by associated perforated tubular members or liners 96, one of which generally surrounds each filter module. A heater arrangement 100 is installed at the inlet end of each module 74. Ground and power electrodes 101 and 102 provide for power to the heater arrangements 100. Perforated tubular liners 96 are closed at their downstream ends 105 so that the exhaust gases must flow from inside out through the filter modules 74.

In use, exhaust gases pass from engine 52 through line 54 into inlet 70. The gases are then directed through perforations 80 into region 107. Region 107 operates as a reactive acoustic element, i.e., it operates as a resonating chamber to attenuate noise. The gases are then directed into regions 108 inside the various filter modules 74. The gases flow outwardly from the filter elements of the filter modules 74, i.e., through liners 96 and into regions 109, leaving particulate material behind. The gases then pass out apertures 110 into resonating chamber 111 and outwardly through outlet 72. Arrows 112 show flow direction.

When it is desired that a selected one of the filter modules 74 be regenerated, the filter module is sealed closed to passage of gases outwardly therefrom, by actuation of an associated poppet valve assembly 114 to close. The heater element associated with the chosen filter element is then actuated to cause regeneration. Air for combustion may be provided by a variety of means, not shown, including: allowance of leakage of some exhaust gas, for example about 1 cubic ft./min. through the system; and/or feed of air from external sources.

As indicated previously the system of FIG. 3 is controlled through unit 60. A buildup of sufficient pressure within any given module, to warrant regeneration, can be measured with a pressure transducer system 116. Other sensor systems may also be used.

For the arrangement of FIG. 3, a poppet valve assembly 114 is installed in association with each of the filter tube modules 74 at the downstream end. Each poppet valve assembly 114 includes a seat member 117. An associated valve member 118 has a head 120 for movement relative to seat member 117, in the region between seat member 116 and the downstream end of the filter tube module 74. Valve stem 121 extends through various support bushings in the housing 50. Valve member 118 is appropriately adapted to be driven between open and closed orientations.

For the arrangement of FIG. 3, the poppet valve assembly is located at the downstream or coolest end of the housing. Also, the filter modules are constructed to have a low mass filter and support mechanism by having a surrounding external tube which provides structural strength. The low mass perforated support tube allows for rapid heating during regeneration and has little effect on propagation of the combustion.

As thus far described, the arrangement of FIG. 3 is generally a known system. The present invention provides substantial improvement to such systems, through the development of a particularly advantageous poppet valve assembly system. Detailed description concerning this is presented with respect to FIGS. 5-13 described below.

A Preferred Poppet Valve Assembly

Figure 5:
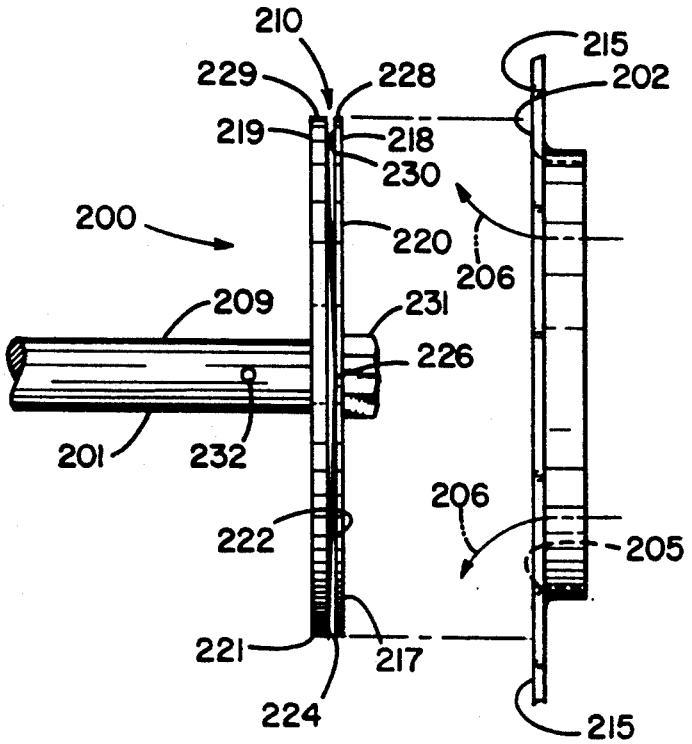
FIG. 5 is an enlarged, fragmentary, side elevational view of a poppet valve assembly, according to the present invention, shown in an open orientation.

A significant departure from conventional poppet valves for certain systems according to the present invention is illustrated in FIGS. 5 and 6. In FIG. 5, poppet valve assembly 200 is illustrated. The assembly 200 comprises piston member 201 and valve seat 202.

In FIG. 5 valve seat 202 defines aperture or port 205. During operation, when the valve assembly 200 is open, as shown in FIG. 5, exhaust gases pass therethrough as illustrated, for example, by arrows 206. That is, the arrangement of FIG. 5 is shown constructed analogously to the arrangement shown in FIG. 3, with the piston 201 closing the valve assembly 200 by having its head pressed against the direction of gas flow. Assemblies according to the present invention may also be utilized in systems in which the gas flow is opposite to that shown in FIG. 5.

Referring to FIG. 5, the piston member 201 comprises a shaft or stem 209 with head member 210 (operating as a closure member) mounted thereon. Head 210 is oriented so that it may be driven, by stem 209, against seat 202, in use, to close aperture 205.

Figure 2:
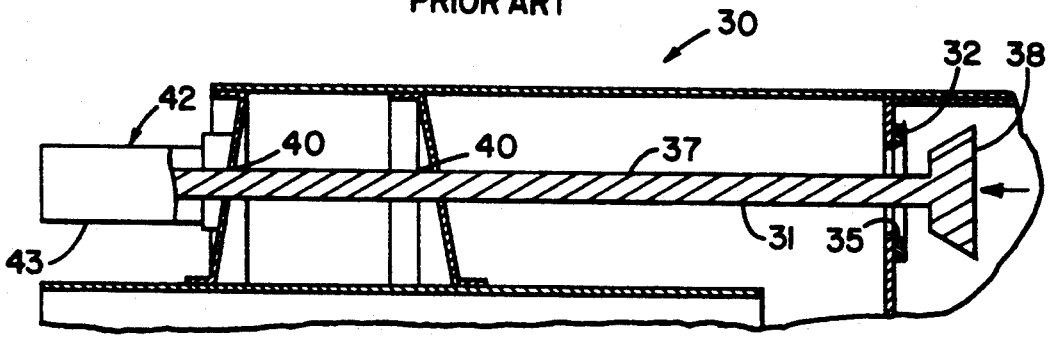
FIG. 2 PRIOR ART
FIG. 2 is a fragmentary schematic view of a prior art poppet valve assembly.

A substantial difference between the arrangement shown in FIG. 5, and the conventional ones of FIGS. 1 and 2, should be apparent. In FIGS. 1 and 2, the arrangement shown involves a head which is received within a recessed seat, for seal. The arrangement of FIG. 5 involves sealing by compression of head 210 against substantially flat surface 215 of seat 202. That is, there is no recessed structure providing for a fit between the head and seat analogous to that of FIGS. 1 and 2. With respect to this, attention is directed to FIG. 6 which shows assembly 200 of FIG. 5 in a closed orientation. Such an arrangement for the seat or surface 215 around valve aperture 205 will be referred to herein as "flat" or "non-recessed."

Assembly 200 is unique with respect to conventional arrangements, in that a precise machining of engaging components (for tight fit) is avoided. That is, a precision machining of seat 202 for receipt therein of a precisely machined head 210 is avoided. In general, all that is necessary is that surface 215 of seat 202 be substantially flat. Thus, seat 202 can be formed from stamped metal, such as stainless steel or the like, and can be relatively inexpensively and conveniently manufactured. Herein the term "seat" in this context is meant to refer to the portion of the valve assembly against which a closure member is pressed, for closing the valve.

From further descriptions, it will be apparent that head 210, of a poppet valve assembly according to the present invention, does not utilize a soft polymeric material for formation of the seal. That is, the seal is formed from a hard material to hard material contact, preferably metal/metal contact, i.e., surface 217 of head 210 is preferably metal, for example stainless steel. A reason for this, again, is that a use of assembly 200, for example in an arrangement as shown in FIGS. 3 and 4, is with respect to relatively high temperature gas situations, for example exhaust gases. It is preferred that the components forming the seal in the valve assembly 200 be metal, to avoid problems with decomposition or degeneration during use.

To provide an effective seal without use of polymeric material and further without precision machining of engaging components, head 210 of the particular embodiment shown has a unique construction. In particular, head 210 comprises a first, flexible, seal portion 218 and a second, relatively rigid, backing portion 219. For the preferred embodiment shown, seal portion 218 comprises a flat seal member 220; and, backing portion 219 comprises backing member 221, the backing member 221 and seal member 220 preferably being separate pieces of material oriented in juxtaposed relation to one another (i.e. in face to face relation). Preferably, the backing member 221 and seal member 220 are oriented with their centers or central portions adjacent and touching. In this context "juxtaposed" is meant to refer to an orientation with face to face overlap, and is not meant to suggest or require that the elements necessarily touch.

Seal member 220 is preferably a flat piece (or sheet) of metal such as stainless steel sufficiently smooth to form a good sealing interaction with a smooth metal surface 215, and possessing a spring characteristic sufficient for the intended use, as defined hereinbelow. For the preferred application shown, the port 205 of the valve assembly 200 will be circular, and seal member 220 will also be circular. Preferably, for typical applications in diesel particulate traps, seal member 220 has a circumference or perimeter which defines an area at least about 10–20% greater than the cross-sectional area defined by the port 205. Preferably, seal member 220 is sized to overlap port 205 by a border at least about 0.4 cm wide completely therearound.

The preferred backing member 221 for the embodiment of FIGS. 5 and 6 is a convex support 222 positioned on a side of seal member 220 opposite from the seat 202. Support 222 is oriented such that a convex surface or side 224 thereof is oriented toward seal member 220. Preferably support 222 has a somewhat spherical curvature, although other arrangements such as conical may be used.

Backing member 221 and seal member 220 are oriented, relative to one another, such that seal member 220 is positioned adjacent backing member 221 in center 226, i.e., in the vicinity of stem 209, and extends such that members 221 and 222 separate from one another by at least about 0.020 inches (0.05 cm), more preferably at least about 0.040 inches (0.1 cm) at or near their respective outer peripheries 228 and 229. Preferably both seal member 220 and curved support 222 have generally circular outer peripheries 229 and 228 respectively, the outer peripheries defining circles of the same approximate size (diameter). It will be understood that the spacing between the outer peripheries 228 and 229 can be related to the amount of misalignment that can be tolerated, between the longitudinal axis of the valve stem and the plane of the valve seat. Generally the greater the gap, the more misalignment that can be tolerated, within operationally defined limits.

Referring to FIGS. 5 and 6, as stem 209 is driven toward valve seat 202, for sealing, seal member 220 is pressed against surface 215. Under pressure, seal member 220 will tend to be bowed until either: its back side 230 is driven back (deflected backwards) to engage backing member 221; or, it reaches a limit of deformation under the pressure applied (or both if, for example, it is deflected more along one portion of its perimeter than another. In either event, the resulting spring tension under which seal member 220 is placed, will tend to reinforce the seal between surface 215 and member 220. In general, actuation means for driving the flexible seal member 220 against surface 215 and backing member 221, comprises the stem 209 and its actuator system.

From the above, it will be apparent that the characteristics of the material for seal member 220 should be such that it will bow under operating pressures, into the appropriate confirmation, and will tend to spring back (has good memory) when pressure is relieved. In general, stainless steel about 0.025 inches (0.064 cm) thick will be appropriate for many applications. Such material is also quite stable under the relatively extreme temperature ranges associated with exhaust systems, for example, −40° F. (−40° C.) or so when turned off through 600° F. (315° C.) or more when operating relatively hot.

In general terms, the material from which the flexible seal member is formed should be such that: it can be sufficiently deflected, under sealing pressures from the actuator, when biased against the valve seat, to form a good seal; and, it possesses sufficient memory (spring) to resist deformation so that the spring tension will prevent unacceptable leakage under the operating pressures. Preferably, the amount of stress applied to the flexible seal member, during sealing, is substantially less than (most preferably $<50\%$ of) the yield stress of the member.

Referring to FIG. 5, for the embodiment shown, the circular seal member 220 and backing member 221 are mounted to stem 209 by means of bolt 231. To insure that bolt 231 does not undesirably loosen during use, locking pin 232 can be provided.

A variety of systems may be utilized for retaining stem 209 in position, and actuating same in use. For example, a bushing construction similar to that described with respect to the piston arrangement of FIG.

3 may be used to slidably support stem 209. Solenoid actuating means, air pressure actuating means, or vacuum actuation means may, for example, be used. Certain preferred actuation means will be described hereinbelow. Before such descriptions, certain advantages of the assembly 200 will be considered.

For example, even if stem 209 is assembled out of perfect perpendicular alignment, or during use becomes out of perfect perpendicular alignment, with surface 215, an effective seal will still be obtained. That is, the arrangement of FIGS. 5 and 6 will form an effective seal even if seal member 220 is not oriented, before sealing, in a plane perfectly parallel to surface 215, since the gap between seal member 220 and backing member 221 allows some accommodation for misalignment. Thus, stem 209 may be at least several degrees, for example, about 1°–4°, out of perpendicular relationship with surface 215, and a good seal can still be obtained. This is particularly advantageous for such systems as truck or bus diesel exhaust systems, at least because they are subject to heavy vibrations and shock during use, both from engine operation and motion of the vehicle.

Another advantage to systems such as those shown in FIG. 5 is that they may be operated to achieve effective seal under moderate closing pressures. Thus, they can be operated with conventional equipment and power systems already on trucks and buses. For example, effective operating pressures can be obtained from the power systems, compression systems or vacuum systems available on conventional vehicles such as diesel trucks and buses. This will be described in greater detail hereinbelow.

A poppet valve assembly such as that illustrated in FIGS. 5 and 6 is particularly well adapted for use with exhaust systems that include particulate material therein. Although located downstream from the filter or trap in FIGS. 5 and 6, such an arrangement could readily be utilized upstream from the filter, since particulate materials in exhaust streams are not sufficiently large or resistant to crush to form a problem with obtaining an effective seal should they become lodged between the engaging surfaces of the seal member 220 and the seat 202.

Valve assemblies according to the present invention may be adapted for use in situations analogous to the conventional arrangement shown in FIG. 2. In particular, attention is now directed to FIGS. 7 and 8. In FIG. 7, an assembly is depicted at 250 comprising piston member 251 and seat 252. The seat 252 defines port 255, preferably of circular configuration. The seat 252 and port 255 may be generally as described with respect to valve assembly 200, FIGS. 5 and 6.

As with the arrangement of FIGS. 5 and 6, piston member 251 comprises a stem 259 and head 260. Head 260 comprises a seal member 261 and backing member 262, also as previously described. The seal member 261 and backing member 262 are mounted on stem 259 by bolt 264. As with the arrangement shown in FIGS. 5 and 6, the seal member 261 is positioned between surface 267 of seat 252, and backing member 262.

Figure 8:
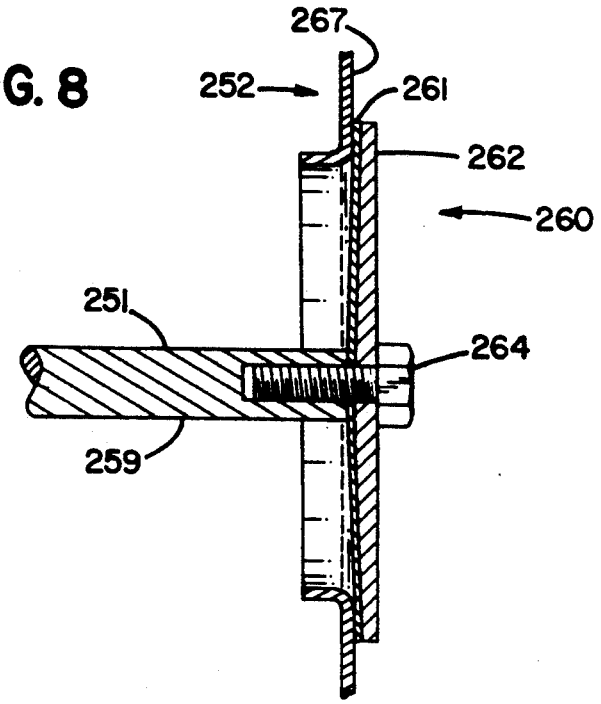
FIG. 8 is an enlarged, fragmentary, cross-sectional view of the embodiment of FIG. 7, shown closed.

The seal member 261 and backing member 262 may be sized and configured analogously for the arrangement shown in FIGS. 5 and 6. The basic difference between the arrangement of FIGS. 7 and 8 is that the seal member 261 and backing member 262 are mounted in reverse orientation, on stem 259. However, they are mounted in the same orientation relative to the valve seat; i.e. the seal member 261 is between the backing member 262 and the valve seat 252. This is done so that the stem 259 may be pulled or drawn in the direction of arrow 268 to generate closing or seal, FIG. 8. In all other manners, the arrangement 250 of FIGS. 7 and 8 may be analogous to that shown for assembly 200, FIGS. 5 and 6. Of course, similar advantages to those resulting for the assembly of FIGS. 5 and 6 are obtained.

In some applications it may be desirable to obtain even greater flexibility with respect to the angular relationship of the stem and the surface of the seat against which the valve head is pressed, during use, than is even obtainable from the arrangement shown in FIGS. 5–8. This can be obtained by providing some flexibility at the point whereat the two-piece head is mounted on the stem. It may also be obtained by providing some flexibility in the stem itself. With respect to this, attention is directed to FIGS. 9 and 10.

Figure 9:
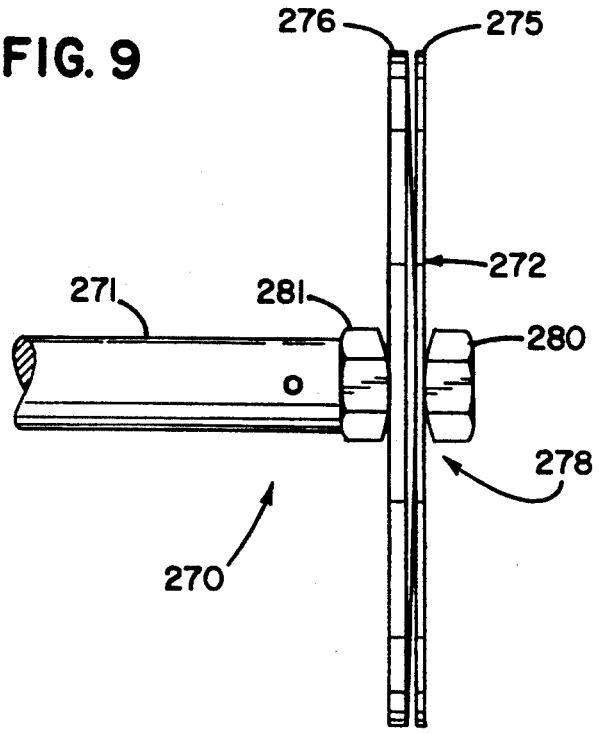
FIG. 9 is an enlarged, fragmentary view of a poppet valve head according to the present invention, shown in an embodiment depicting a swivel mount.
Figure 10:
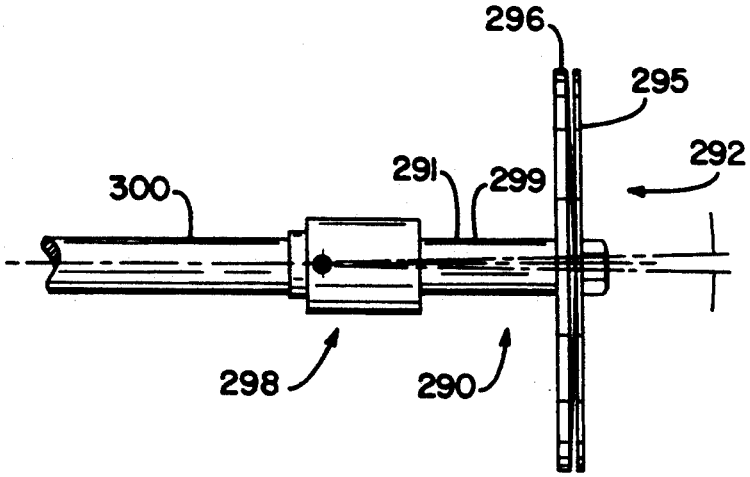
FIG. 10 is an enlarged fragmentary view of a poppet valve head according to the present invention, shown in an embodiment involving a valve stem flexible coupling.

Referring to FIG. 9, a system for providing some wobble or flexibility where the head is mounted to the stem is illustrated. In FIG. 9, piston member 270 is illustrated, comprising stem 271 and head 272. Head 272 comprises seal member 275 and curved backing member 276. The particular arrangement illustrated in FIG. 9 is analogous to that of FIG. 5; however, the principles described with respect to the mount may be applied to an arrangement configured such as that shown in FIG. 7, as will be apparent.

For the arrangement of FIG. 9, head 272 is mounted to provide some wobble relative to stem 271 by means of swivel fastener 278. The swivel fastener 278 comprises two heads 280 and 281 between which the seal member 275 and backing member 276 are positioned. Each of the heads 280 and 281 has a convex outer surface, directed toward the head 272. The swivel fastener 278 allows for some wobble of the head 272 on the stem 271, without loss of seal under conditions of closure. Thus, even greater angular misalignment is tolerated, to advantage.

In addition, since poppet valve assemblies according to the present invention can tolerate some angular misalignment between the head and the seat during sealing, flex can be provided for in other portions of the system, such as other portions of the stem. With respect to this, attention is directed to FIG. 10. Therein a piston member 290 is depicted comprising stem 291 and head 292. Head 292 comprises a two-piece construction of seal member 295 and backing member 296. For the arrangement shown in FIG. 10, the seal member 295 and backing member 296 are configured, relative to one another, analogously to the embodiment shown in FIGS. 7 and 8. It will be understood however, that the principles of importance with respect to the stem 291 described can be applied in a system configured analogous to that shown in FIGS. 5 and 6.

More specifically, flexibility is provided in stem 291 by flexible coupling 298. Flexible coupling 298 provides for some flex or relative angular movement between stem sections 299 and 300, respectively. This can allow for some stress to be taken off bushings or the like, not shown, even when head 292 is pressed against the surface of a seat at what is initially a somewhat angular relationship. Again, this is accommodated in part by the fact that the head 292 is constructed to allow for a good seal even when it is not driven against a seat in a direction perfectly perpendicular to the sealing surface of the seat. A conventional flexible coupling such as that available from Parker Fluidpower, Cylinder Division, Des Plaines, Ill. 60016, and allowing about 1° movement from the perpendicular (i.e. 2° total) is a useable system.

Figure 13:
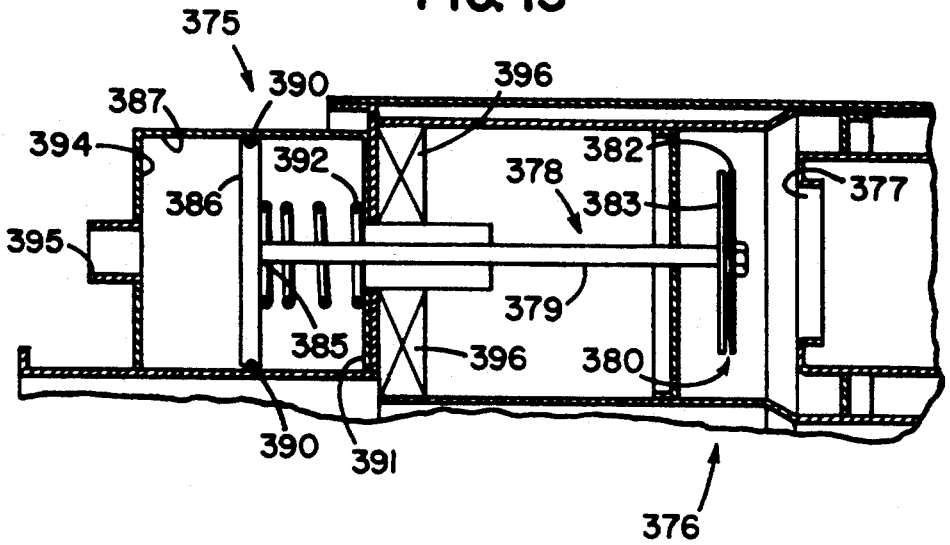
FIG. 13 is a fragmentary schematic representation of a poppet valve assembly according to the present invention in an embodiment involving a piston plate with a circumferential seal.

In the alternative, the stem could be constructed from flexible material. As suggested above, a variety of actuation means may be utilized to control motion of the piston member in poppet valve assemblies according to the present invention. In fact, it is a particular advantage of assemblies according to the present invention that they are adapted for use with a variety of actuation means or mechanisms, with good results. Some examples of this are illustrated in FIGS. 11 through 13.

Figure 11:
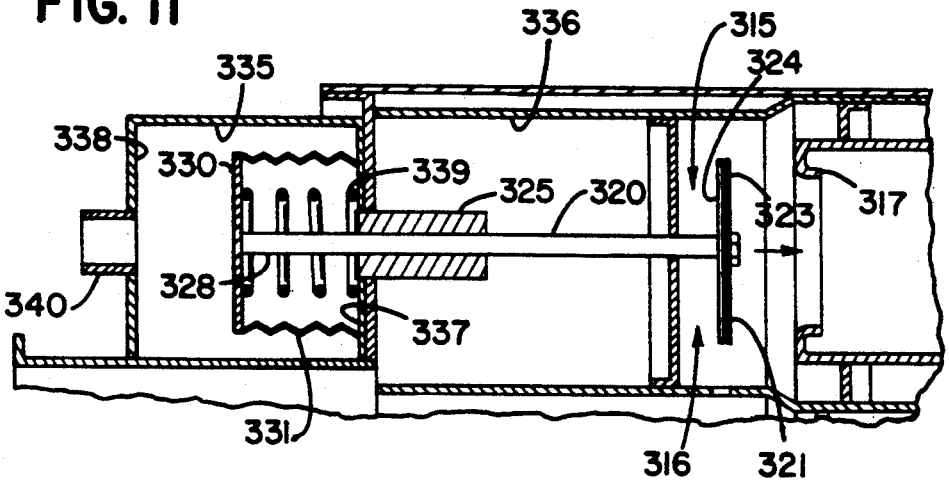
FIG. 11 is a fragmentary schematic representation of a poppet valve assembly according to the present invention in an embodiment involving a piston plate and bellows actuator.
Figure 12:
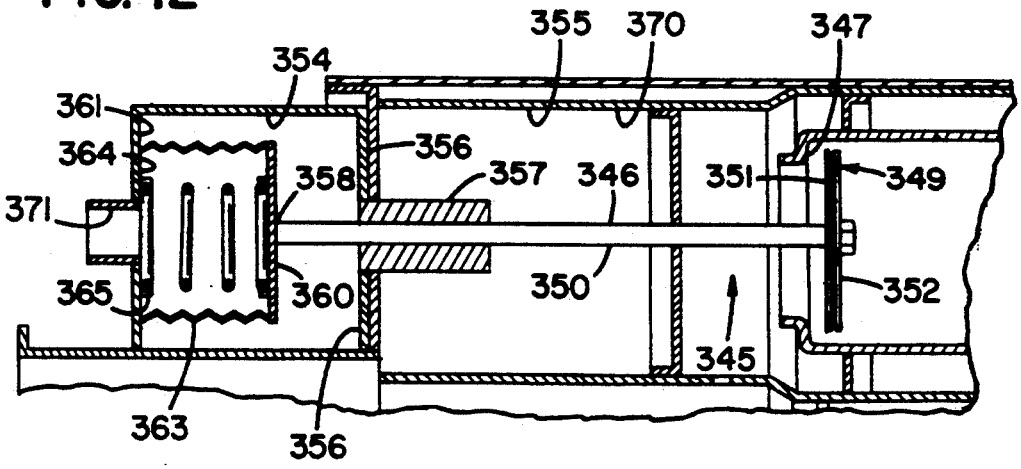
FIG. 12 is a fragmentary schematic representation of a poppet valve assembly according to the present invention in an alternate embodiment of FIG. 11, involving an alternate plate and bellows configuration.

Referring to FIG. 11, a particular actuator mechanism utilizing a bellows seal is shown. In FIG. 11, a poppet valve assembly 315, according to the present invention is illustrated. Valve assembly 315 comprises piston member 316 and valve seat 317. Piston member 316 comprises stem 320 and head 321. Head 321 comprises seal member 323 and backing member 324. The particular configuration of seal member 323 and backing member 324, for the arrangement shown in FIG. 11, is analogous to that for the valve assembly of FIGS. 5 and 6, and indeed the actuation arrangement of FIG. 11 may be viewed as useable in an overall embodiment analogous to that of FIGS. 3 and 4.

Stem 320 is mounted in extension through guide 325. On end 328 of stem 320, opposite head 321, a piston plate 330 is mounted.

Stem 320 extends from volume 335, in which plate 330 is received, through guide 325 to volume 336, in which head 321 is received. Volumes 335 and 336, separated by wall 337 are preferably isolated from one another, so that if pressure in volume 335 is reduced relative to pressure in volume 336, plate 330 will be drawn away from wall 337 toward wall 338. Alternatively, if pressure within volume 335 is increased, relative to pressure in volume 336, plate 330 will generally be driven toward wall 337. A flexible seal between the two regions is in part provided by a flexible metal bellows 331 welded in extension between plate 330 and wall 337, and forming a circumferential seal around portions of the assembly associated with stem 320 and guide 325.

The arrangement shown in FIG. 11 is advantageous, in that polymeric seals or the like are avoided. Again, relatively high temperature conditions within exhaust gas systems generally make polymeric seals undesirable, at least without substantial heat insulation. Such an arrangement as FIG. 11 will be generally referred to herein as a plate and metal bellows seal arrangement.

For the arrangement shown in FIG. 11, biasing spring 339 is provided in extension between wall 337 and plate 330. Thus, should a pressure control system for volume 335 fail, the valve assembly 315 will be biased to an open position. This is generally desirable for an assembly such as that shown in FIGS. 3 and 4. It will be understood that the arrangement could be configured, for certain applications, with the fail-safe spring oriented to maintain the piston closed under failure conditions.

Pressure changes in volume 335 are selectively accomplished through pressure line 340, in communication therewith.

An arrangement such as that shown in FIG. 11 does not require substantial heat insulation for the system in volume 335, from the extreme conditions in volume 336 in use. Thus, it is highly advantageous. Poppet valve assemblies according to the present invention facilitate this advantage, since they operate under pressure conditions readily obtainable for such applications. Also, they can operate even should components be a little bit out of alignment, as previously described. Further, they can be operated quite well under somewhat extreme temperature conditions, to advantage.

An arrangement utilizing a bellows similar to that shown in FIG. 11, may be used for actuation of a system which operates similarly to that shown in FIGS. 7 and 8. Such an assembly is illustrated in FIG. 12.

Referring to FIG. 12, valve assembly 345 comprises piston member 346 and valve seat 347. Piston member 346 comprises head 349 and stem 350. The head 349 comprises seal member 351 and backing member 352. Stem 350 extends between volumes 354 and 355, separated by wall 356, by extension through guide 357.

An end 358 of stem 350 remote from head 349 is capped by plate 360. Plate 360 is sealed to back wall 361 by flexible metal bellows 363, thus defining sealed volume 364. Safety spring 365 is provided between wall 361 and plate 360, thus biasing plate 360 away from wall 361, under conditions of system failure. This will result in head 349 being pushed away from seat 347 under conditions of failure of control of pressure within region 364.

As the pressure within region 364 is reduced, relative to pressure in region 370, head 349 will be drawn toward seal 347, in sealing relationship therewith. A vacuum (reduced pressure) can be provided in region 364 to accomplish this, by control line 371.

The arrangement of FIG. 11 could be reconfigured for operation to close under vacuum draw from line 340, by having bellows 331 extend between back wall 338 and plate 330, rather than between wall 337 and plate 360. Further, the arrangement of FIG. 12 could be configured to operate (close) under increased pressure applied by line 370, rather than vacuum, by having bellows 363 extend between plate 360 and central wall 366, rather than between plate 360 and back wall 361.

In addition, the biasing spring utilized in either FIGS. 11 and 12 could be oriented to have its direction of biasing being to close or seal the system, rather than maintain the system open. Again, this will not generally be preferred when the system of use is a particulate trap for exhaust gases.

Further review of FIGS. 11 and 12, and the alternatives suggested in previous paragraphs, indicates great advantage to systems according to the present invention generally analogous to those described with respect to FIG. 11. Polymeric systems that might be sensitive to temperature problems are avoided, and excessive measures for insulation of the control mechanism for actuation from the gas flow regions are not needed. Further, the systems are relatively simple and easy to construct, and can be manufactured to operate for extended periods of time, even under stress conditions such as vibration and movement. Further, since the poppet valve assemblies can accommodate some movement of parts out of alignment, while still maintaining an effective seal, constructions such as those shown in FIGS. 11 and 12 are facilitated.

However, alternative systems to the advantageous bellows arrangement may be utilized. With respect to this, attention is directed to FIG. 13. Referring to FIG. 13, an actuator mechanism is indicated generally at reference numeral 375. In particular, FIG. 13 depicts valve assembly 376 having valve seat 377 and piston member 378. Piston member 378 comprises stem 379 and head 380. Head 380 comprises seal member 382 and backing member 383. End 385 of stem 379, opposite head 380, includes plate 386 thereon. A sealed arrangement between plate 386 and wall 387 is provided by a circumferential seal 390. Plate 386 is biased away from wall 391 by safety spring 392 which, it will be apparent, provides that, under system failure, head 380 is biased away from closing relationship with valve seat 377.

As a result of circumferential seal 390, volume 394 is closed, and serviced by pressure line 395. An increase of pressure in volume 394 will generally drive plate 386 toward wall 391, and thus head 380 toward valve seat 377. Thus, a convenient actuator system is provided. When the assembly of FIG. 13 is intended for use with systems involving relatively high temperature gases around valve seat 377, it is desirable to isolate seal 390 from the high temperatures of the system, since typically seal 390 will be formed from a flexible polymeric material. This is provided by insulation 396. As an alternative, or in addition, a finned set off could be utilized in partial extension between wall 391 and plate 386.

A Specific Example Of Application

The general utility of poppet valve assemblies according to the present invention will be still further understood from the following example. A diesel exhaust particulate trap such as that illustrated in FIGS. 3 and 4 will utilize four poppet valve assemblies for control of four filter modules. The temperature of the exhaust gases will range up to about 600° F. (315° C.) or more. The volume and flow rate of diesel exhaust from a typical truck, bus or the like will necessitate a valve seal port or aperture, for each valve assembly, of about 5–7 cm, and typically about 6 cm diameter. The valve seat can be prepared by stamping a sheet of flat stainless steel to provide for a port of the appropriate size.

A piston assembly usable in such a system comprises a stem or shaft of about 1 cm diameter, comprising steel with a hardened melanite coating. The head comprises a steel backing of at least about 6.8–7.2 cm diameter when the port is about 6 cm diameter, allowing an overlap or circumferential ring of about 0.4–0.7 cm width. The backing member comprises a circular piece of steel having a thickness of about 0.25 cm, and a convex face pressed or stamped to a spherical surface allowing for an overall difference in height between the center and the edge of about 0.040 inches (0.1 cm). That is, if the "back side" of the backing member, or side away from the seal member, is flat, the central portion of the backing is about 0.040 inches (0.1 cm) thicker than the edge of the backing.

The seal member of the head portion comprises a flat, circular, piece of stainless steel having a thickness of about 0.06 cm. Preferably it is 0.025 inch (0.064 cm) hardened 304 stainless steel. The outside diameter of the seal portion is preferably the same as the backing member. The seal member and backing are preferably sized and chosen such that the seal member will deflect into seating on the curved backing member under a force applied to the stem of at least about 10–15 lbs and preferably within that range.

The backing member and seal portion, i.e., the head, is mounted on the piston stem by a bolt extending through the head. The bolt is locked in place by a pin extending through a portion of the stem or shaft.

For use with an exhaust system such as that described above, and depicted in FIGS. 3 and 4, it is desirable that the seal be effective for no more leakage than about 1 cubic foot of gas, per minute. Excessive leakage will tend to cool the filter modules undesirably, during the regeneration process. The poppet valve design described herein can readily achieve such a seal, against exhaust gas pressures, when the seal member is pressed against the valve seat, and in between the valve seat and the backing member, under a pressure applied to the valve stem of about 10 psi or so. This will be more than enough to counter the maximum pressures generally seen in an engine, i.e., about 12 inches of mercury or about 6 psi.

A pressure of 10 psi, for operation of the valve assembly, can be readily tapped from conventional engines. For example, if an over-the-road truck having air brakes is involved, the compressed air system for the air brakes is capable of generating at least about 100 psi pressure. Thus, the compressed air system is more than able to provide for operation of the valve assembly. If the assembly is mounted in a pickup truck or the like, with a vacuum pump for controlling power steering, power brakes or the like, a pressure of about 27 inches of mercury (about 13.25 psi) is generally available from the compressor. Again, this is more than enough to operate the valve assembly.

Of course, each of the above systems can be operated either through a piston actuation mechanism which is actuated upon application of a vacuum or alternatively increased pressure, to cause motion of the parts and effective sealing. As an alternative, a solenoid system or mechanical link system could be used. These could be actuated with air, hydraulic or electrical power derived from the vehicle.

From the above-recited example, general principles of operation will be understood. In particular, to some extent the amount of curvature to the backing member will be related to the size of the seal member or diaphragm involved, i.e., the size of the aperture involved. A good effective seal, typically capable of withstanding some misalignment between the plane of the seal member and the plane of the seat, up to at least several degrees, can generally be obtained with a peripheral gap between the seal member and the backing member of about 30–50 thousandths of an inch (0.08–0.13 cm), when the ports are chosen such that the seal member will deflect into seating with the backing member, under a force of about 12–18 lbs.

SOME VARIATIONS IN APPLICATIONS OF THE PRESENT INVENTION

From the previous discussions, general principles relating to the present invention have been developed. Specific preferred embodiments relating to development of the pocket valve for use in diesel engine particulate traps, especially in vehicles such as trucks or buses, have been presented. In this portion of the description, variations in applications in certain general principles are presented.

A. Application of the Invention in an Embodiment without a Backing Member

Figure 15:
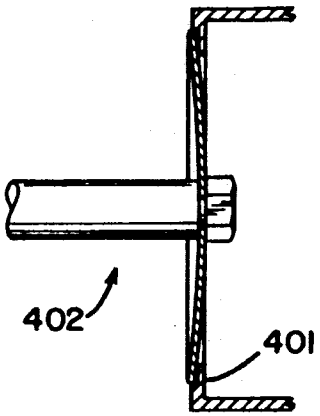
FIG. 15 is a depiction of the arrangement of FIG. 14, shown closed.
Figure 14:
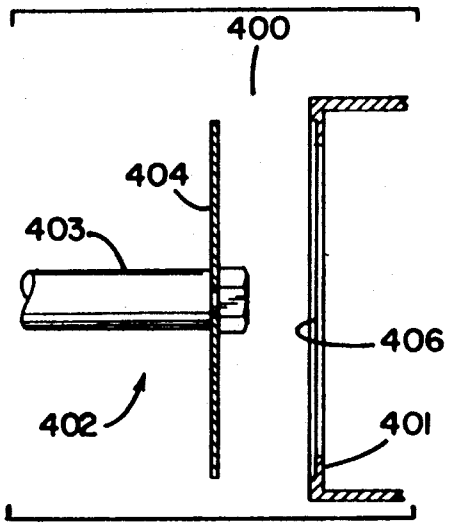
FIG. 14 is a fragmentary schematic representation of a second alternate embodiment shown in an open orientation.

If an appropriate seal member is chosen, and appropriate control is utilized over the actuation system, in some applications a poppet valve assembly according to the present invention may be provided without the utilization of the backing member. With respect to this, attention is directed to FIGS. 14 and 15, which show such a valve. In FIG. 14, the valve was shown "open". In FIG. 15, in contrast, it is shown closed.

Referring to FIG. 14, a valve assembly 400 is depicted which comprises valve seat 401 and seal member 402. Seal member 402 comprises a valve stem 403 with a flexible sealing member 404 mounted thereon. The sealing member 404 may be constructed relative to the valve seat 401 similarly to the construction described with respect to FIGS. 5 and 6.

From a comparison of FIGS. 14 and 15, it will be understood that aperture 406 in valve seat 401 is sealed, selectively, when sealing member 404 is pressed against valve seat 401, in a manner somewhat similar to that for the arrangement shown in FIGS. 5 and 6. A substantial difference, however, results from the fact that a backing member is not used. Under such circumstances, backward flex, i.e. flex backed toward stem 402 during closure as shown in FIG. 15, of the sealing member 404 is controlled, primarily, by two principal variables: the stroke length of the stem 402, provided by the actuator; and, the rigidity (i.e. memory and resistance to flex) of the seal member 404. Again, the flexible seal member 404 retains a seal, due to its spring strength. Its resistance to stress as with other embodiments as described herein, should be sufficient so that its spring strength maintains a good seal under circumstances in which its yield stress (or point of fatigue) is not approached or passed. As with previous arrangements described herein, the arrangement of FIGS. 14 and 15 can withstand considerable angular misalignment (i.e. the longitudinal axis of stem 402 can be substantially out of perpendicular alignment with valve seal 401, with a good seal still maintained. The arrangement of FIGS. 14 and 15, will, in general, require relatively precise control over actuation pressure and stroke length for the stem 402, to ensure proper operation. For the arrangement shown in FIGS. 5 and 6, the backing member provides some assistance with control of flex, and thus in some applications less precise control of stroke length and/or pressure is possible for such an arrangement.

B. Application with a Flexible Member that is Not Flat

Figure 16:
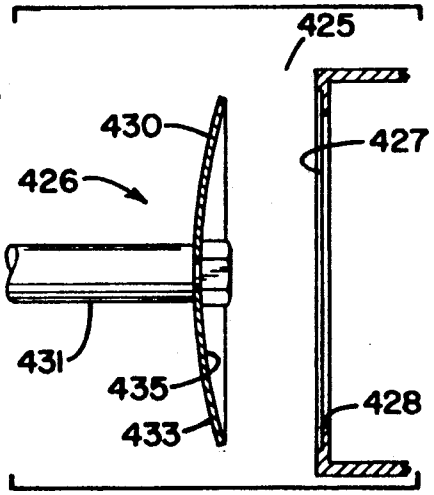
FIG. 16 is a fragmentary schematic of a third alternate embodiment, shown in an open orientation.

For the specific embodiments illustrated thus far, the flexible sealing member has been presented as flat. It is anticipated this will be advantageous for utilization in such systems as the diesel exhaust particulate traps represented by FIG. 3. However, it is expected that in some applications a flexible seal member may be utilized with the proper valve assembly according to the present invention, which is not flat in its configurations. With respect to this, attention is directed to FIGS. 16 and 17. In FIG. 16 a valve assembly 425 is depicted which comprises a piston member 426 and valve seat 427 having aperture 428 therein. The piston member 426 comprises head 430 and stem 431. For the arrangement shown in FIG. 16, the head 430 comprises flexible seal member 433. The arrangement shown in FIGS. 16 and 17 is shown without a backing member, however, a backing member could be utilized therewith.

Figure 17:
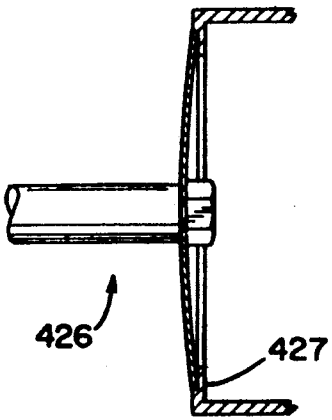
FIG. 17 is the embodiment of FIG. 16, shown closed.

For the embodiment of FIGS. 16 and 17, flexible seal member 433 is not flat, but rather has a curved, concave side 435 directed toward valve seat 428. When operated similarly to the embodiment shown in FIGS. 5 and 6, aperture 428 can be readily sealed closed.

Figure 18:
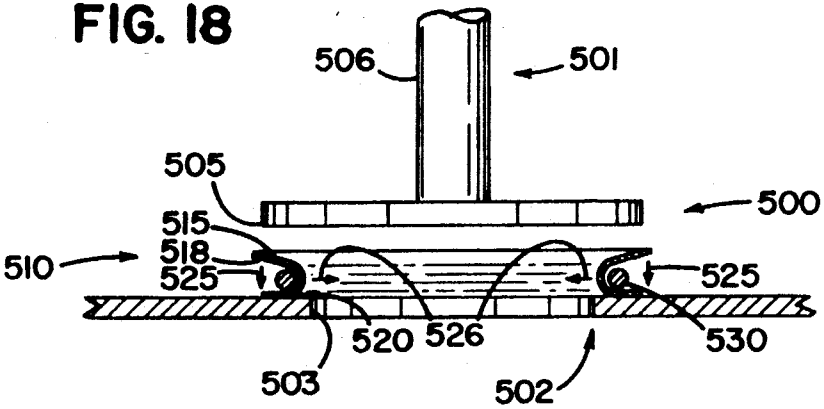
FIG. 18 is a fragmentary schematic of a fourth alternate embodiment, shown open.

In general for embodiments as shown in FIGS. 16 and 17, it is preferred that the flexible seal member 435 be designed such that, through the operable stroke length of the arrangement 425, the seal member 433 is not flexed or distorted through its center point. In the application of FIGS. 17 and 18, this would mean that the stroke length of the stem 431 should be sufficiently short so that when the valve assembly 425 is closed, seal member 433 is not deformed backwardly past "flat". If it were, undesirable spring (oil canning) may result, or undesirable yield or stress on the seal member 433 could result.

The arrangement shown in FIGS. 16 and 17, it will be understood, is indicative of general principles of applications according to the present invention. For example, the valve seal 428 may be constructed "non-flat" as well. Further, various shapes of flexible members 433 could be used, including ones custom shaped to fit unusually shaped valve seats 427.

C. Applications Wherein a "Flexible Member" is Positioned on the Valve Seat

In some applications, the flexible member may be positioned on the valve seat and the rigid member pressed thereagainst positioned on the moveable (piston) member of valve. Two embodiments illustrating this are depicted in FIG. 18–21.

Figure 19:
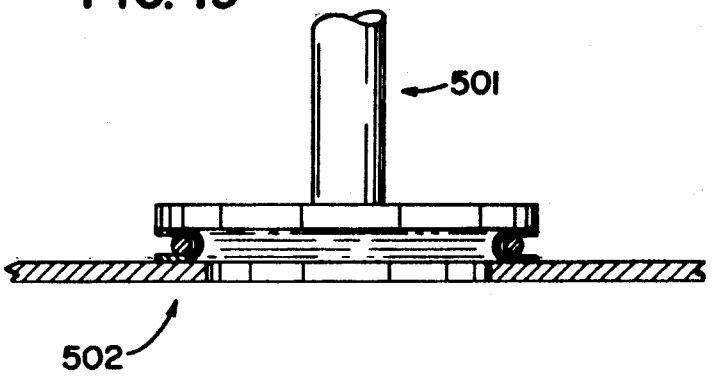
FIG. 19 is the embodiment of FIG. 18, shown closed.

Attention is first directed to the embodiment first depicted in FIGS. 18 and 19. In FIG. 18 the arrangement is shown "open", and in FIG. 19 "closed".

Referring to FIG. 18, valve assembly 500 comprises a piston member 501 and valve seat 502. The valve seat 502 comprises a circular aperture 503 through which air or other fluid passes in use. Piston member 501 comprises rigid head 505 and moveable stem 506. By "rigid" in this context, i.e. in reference to head 505, it is meant that the head 505 comprises a material such as steel or the like not likely to flex or deform under the pressures of use.

Although variations may be tolerated, the arrangement illustrated in FIGS. 18 and 19 is one with a circular aperture 503 and circular piston head 505.

The arrangement depicted in FIGS. 18 and 19 has a flexible seat arrangement 510 against which rigid member 505 is directed, in use, to close and seal the arrangement (see FIG. 19). Flexible seat arrangement 510 comprises flexible circular diaphragm member 515. Diaphragm 515 is shaped with a generally C-cross section, with an upper or outer extension 518 sufficiently long to provide for the seal, as described. Diaphragm member 515 is attached to rigid seat 502 circumferentially around aperture 503, as for example at weld 520.

Since diaphragm 515 is generally flexible, when head 505 is pressed thereagainst diaphragm 515 will deform, generally in the directions of arrows 525 and 526, FIG. 18. Rigid ring 530 provides a stop, so that flexible member 515 is generally compressed between head 505 and ring 530. Distortion or flexing of the curved portion of diaphragm 515 in the direction of arrows 526 allow a compression to take place which can lead to a sealing contact. The presence of the ring 530, again, helps control stroke length for piston 501. It is foreseen that diaphragm 515 would be provided from a material of appropriate strength and thickness to allow for sufficient resistance to deformation, to provide a good seal. It is anticipated that flexible stainless steal diaphragms may be readily used, especially those with flexing characteristics similar to flexible members described previously herein. A variety of materials may be utlized for ring 530, including a rigid steel member attached or secured to diaphragm 515 in the region approximately opposite to seal 520.

Figure 21:
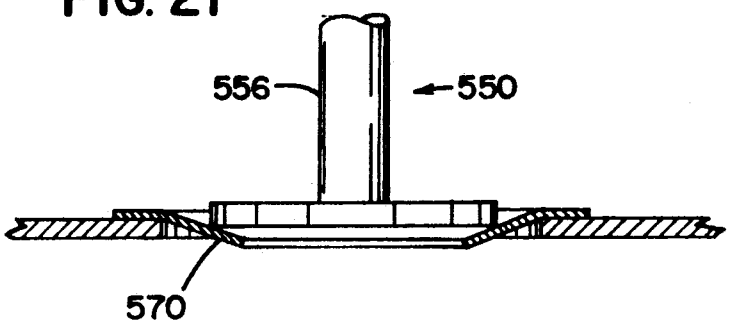
FIG. 21 is the embodiment of FIG. 20, shown closed.
Figure 20:
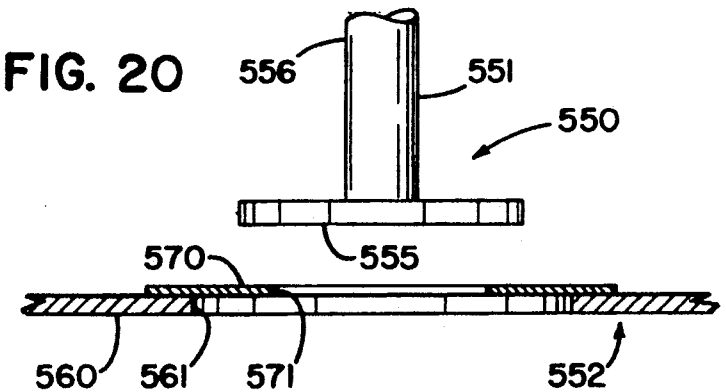
FIG. 20 is a fragmentary schematic of a fifth alternate embodiment, shown open.

Referring to FIGS. 20 and 21 an alternate embodiment involving a stationary flexible member is shown. Referring to FIG. 20, an arrangement 550 is depicted comprising piston member 551 and valve seat 552. Piston member 551 comprises rigid head 555 and stem 556. By "rigid" in this context, it is meant that head 555 does not generally flex as it is pressed against the valve seat.

Valve seat 552 comprises a rigid wall 560 having aperture 561 therein. While there is no requirement that it be such, generally for the embodiment shown in FIGS. 20 and 21 valve head 555 and aperture 561 are generally circular. As illustrated in the drawings, the diameter of valve head 555 is smaller than the diameter of aperture 561. The relative dimensions are preferably such as to allow for the desired flex in the valve seat, described hereinbelow, to achieve good seal.

Flat, flexible, diaphragm 570 is depicted positioned on rigid wall 560 and in partial extension over aperture 561. Diaphragm 570 defines central aperture 571, of smaller diameter than head member 555. When it is desired that arrangement 550 be closed, FIG. 21, generally piston member 550 is driven toward diaphragm 570 until rigid head 555 sufficiently engages same, deflecting head 570 and sealing aperture 571 closed. It is foreseen that a similar material to that used for flexible members described throughout this document may be utilized for diaphragm 570. It will be understood that in general the arrangement of FIGS. 20 and 21 will require control on the stroke of piston member 550 since no backstop is provided against which diaphragm 570 is deflected.

What is claimed is:

1. An assembly for control of hot gas flow, said assembly comprising:

(a) a diesel exhaust particulate trap;

(b) means for selectively regenerating said particulate trap;

(c) a gas flow passageway in gas flow communication with said diesel exhaust particulate trap; said gas flow passageway defining a flow aperture;

(d) flow direction means for selectively directing hot gas flow through said flow passageway and flow aperture;

(e) a poppet valve assembly comprising:

(i) a valve seat comprising a flat, non-recessed, metal surface oriented to circumscribe said flow aperture;

(ii) a valve head member comprising a flexible seal member and a backing member; said seal member and said backing member being oriented in juxtaposed relation to one another; said backing member having a convex surface directed toward said flexible seal member; and, said flexible seal member being oriented between said backing member and said valve seat; and, (f) actuation means for selectively biasing said flexible seal member against said valve seat while deflecting said seal member toward said backing member convex surface.

2. An assembly according to claim 1 wherein:

(a) said diesel exhaust particulate trap is positioned upstream of said flow aperture;

(b) said flow direction means is constructed and arranged to direct exhaust gas flow from said particulate trap through said flow aperture; and, (c) said means for selectively regenerating said trap comprises an electric heater arrangement.

3. An assembly according to claim 1 including:

(a) a plurality of said diesel exhaust particulate traps; and (b) a plurality of poppet valve assemblies.

4. An assembly according to claim 1 wherein said actuation means is constructed and arranged to bias said valve head member against a direction of gas flow through said flow aperture, while closing said poppet valve assembly.

5. A poppet valve assembly according to claim 1 wherein said flexible seal member comprises a flat piece of metal.

6. A poppet valve assembly according to claim 5 wherein:

(a) said flexible seal member has a circular outer periphery; and, (b) said backing member has a circular outer periphery.

7. A poppet valve assembly according to claim 6 wherein said backing member convex surface has a substantially spherical curvature.

8. A poppet valve assembly according to claim 6 wherein:

(a) said flexible seal member outer periphery and said backing member outer periphery are spaced at least about 0.020 inches (0.05 cm) apart, when said valve assembly is open; and, (b) said flexible seal member and said backing member have adjacent central portions.

9. An arrangement according to claim 8 wherein said valve seat circumscribes a circular flow aperture at least about 6.0 cm in diameter.

10. A poppet valve assembly according to claim 1 wherein:

(a) said actuation means includes a valve stem arrangement and motive means for selectively moving said valve stem arrangement;

(b) said motive means including a plate and metal bellows seal arrangement constructed and arranged to bias said valve stem upon selected control of relative gas pressures in volumes separated by said plate and metal bellows seal arrangement.

11. An assembly according to claim 10 including a biasing member oriented to retain said valve seat open, unless said head member is selectively biased thereagainst by said actuation means.

12. A poppet valve assembly according to claim 1 wherein:

(a) said actuation means includes a valve stem; and, (b) said assembly includes a swivel fastener; said valve head member being mounted on said valve stem by said swivel fastener, in a manner allowing for some wobble between said valve head member and said valve stem.

13. A poppet valve assembly according to claim 1 wherein:

(a) said actuation means includes a valve stem arrangement with a flexible coupling therein; said valve head member being mounted on a first end of said valve stem arrangement;

(i) said flexible coupling being constructed and arranged to permit angular wobble between said first end of said valve stem arrangement and a portion of said valve stem arrangement on an opposite side of said flexible coupling from said first end of said valve stem arrangement.

14. An assembly for control of hot gas flow; said assembly comprising:

(a) an exhaust particulate trap;

(b) means for selectively regenerating said particulate trap;

(c) an exhaust flow passageway in gas flow communication with said exhaust particulate trap; said gas flow passageway defining a flow aperture;

(d) flow direction means for selectively directing hot gas flow through said flow passageway and flow aperture;

(e) a poppet valve assembly comprising:

(i) a poppet valve assembly comprising:

(ii) a valve head member comprising a flexible seal member and a backing member; said backing member having a convex surface directed toward said flexible seal member; said flexible seal member being oriented between said backing member and said valve seat; and, (iii) actuation means for selectively biasing said flexible seal member against said valve seat while deflecting said seal member toward said backing member convex surface.

15. A poppet valve assembly according to claim 14 wherein:

(a) said actuation means includes a valve stem arrangement and motive means for selectively moving said valve stem arrangement;

(b) said motive means including a plate and metal bellows seal arrangement constructed and arranged to bias said valve stem upon selected control of relative gas pressures in volumes separated by said plate and metal bellows seal arrangement.

16. An assembly according to claim 15 including a biasing member oriented to retain said valve seat open, unless said heat member is selectively biased thereagainst by said actuation means.

17. A poppet valve assembly according to claim 14 wherein:

(a) said flexible seal member has a circular outer periphery; and, (b) said backing member has a circular outer periphery.

18. A poppet valve assembly according to claim 17 wherein said backing member convex surface has a substantially spherical curvature.

19. A poppet valve assembly including:

(a) a valve seat;

(b) a valve head member comprising a flexible seal member and a backing member; said seal member and said backing member being oriented in juxtaposed relation to another;

(i) said backing member having a convex surface directed toward said flexible seal member;

(ii) said flexible seal member being oriented between said backing member and said valve seat; and, (c) actuation means for selectively biasing said flexible seal member against said valve seat while deflecting said seal member toward said backing member convex surface;

(i) said actuation means including a valve stem arrangement and motive means for selectively moving said valve stem arrangement; said motive means including a plate and metal bellows seal arrangement constructed and arranged to bias said valve stem upon selected control of relative gas pressures in volumes separated by said plate and metal bellows seal arrangement.

20. An assembly according to claim 19 including a biasing member oriented to retain said valve seat open, unless said head member is selectively biased thereagainst by said actuation means.

21. A poppet valve assembly according to claim 19 wherein:

(a) said flexible seal member has a circular outer periphery; and, (b) said backing member has a circular outer periphery.

22. A poppet valve assembly according to claim 21 wherein said backing member convex surface has a substantially spherical curvature.

* * * * *

UNITED STATES PATENT AND TRADEMARK OFFICE
CERTIFICATE OF CORRECTION

PATENT NO. : 5,246,205

DATED : September 21, 1993

INVENTOR(S) : Gillingham et al.

It is certified that error appears in the above-identified patent and that said Letters Patent is hereby corrected as shown below:

Column 2, line 61, delete "value" and insert therefor --valve--.

Column 16, line 66, delete "closed" and insert therefor --"closed"--.

Column 18, line 18, after "of", insert --the--.

In Claim 19 at column 22, line 9, after "relation to", insert --one--.

Signed and Sealed this

Third Day of October, 1995

*Attest:*

Bruce Lehman

BRUCE LEHMAN

*Attesting Officer*

*Commissioner of Patents and Trademarks*